US009245700B2

(12) United States Patent
Thomas

(10) Patent No.: US 9,245,700 B2
(45) Date of Patent: Jan. 26, 2016

(54) CIRCUIT BREAKER

(71) Applicant: ABB TECHNOLOGY LTD, Zürich (CH)

(72) Inventor: Richard Thomas, Borlänge (SE)

(73) Assignee: ABB TECHNOLOGY LTD, Zurich (CH)

( * ) Notice: Subject to any disclaimer, the term of this patent is extended or adjusted under 35 U.S.C. 154(b) by 0 days.

(21) Appl. No.: 14/409,641

(22) PCT Filed: Aug. 9, 2013

(86) PCT No.: PCT/EP2013/066712
§ 371 (c)(1),
(2) Date: Dec. 19, 2014

(87) PCT Pub. No.: WO2014/026924
PCT Pub. Date: Feb. 20, 2014

(65) Prior Publication Data

US 2015/0179364 A1 Jun. 25, 2015

(30) Foreign Application Priority Data

Aug. 17, 2012 (EP) ..... 12180774

(51) Int. Cl.
*H01H 1/44* (2006.01)
*H01H 9/52* (2006.01)
(Continued)

(52) U.S. Cl.
CPC . *H01H 9/52* (2013.01); *H01H 1/06* (2013.01); *H01H 1/36* (2013.01); *H01H 1/38* (2013.01); *H01H 1/44* (2013.01); *H01H 1/62* (2013.01); *H01H 45/10* (2013.01); *H01H 33/7046* (2013.01); *H01H 33/7076* (2013.01)

(58) Field of Classification Search
CPC ..... H01H 3/00; H01H 3/02; H01H 3/04; H01H 3/12; H01H 13/00; H01H 13/20; H01H 13/50; H01H 1/12; H01H 2003/00; H01H 2003/02; H01H 2009/02; H01H 2021/00; H01H 2217/002; H01H 2221/00; H01H 2221/016; H01H 2221/018; H01H 2221/022; H01H 2231/016; H01H 2231/026; H01H 2239/006; H01H 2300/01; H01H 1/02
USPC ..... 200/262–276
See application file for complete search history.

(56) References Cited

U.S. PATENT DOCUMENTS 3,571,547 A 3/1971 Boersma et al.
3,613,036 A 10/1971 Kurtz
(Continued)

FOREIGN PATENT DOCUMENTS

DE 43 33 277 A1 3/1995
JP 8-18629 U 1/1933
(Continued)

*Primary Examiner* — Edwin A. Leon
*Assistant Examiner* — Anthony R. Jimenez
(74) *Attorney, Agent, or Firm* — Birch, Stewart, Kolasch & Birch, LLP

(57) ABSTRACT

A circuit breaker including a first and a second contact movable relative each other between an open position, in which the contacts are at a distance from each other, and a closed position, in which the contacts are in electrical contact with each other. The first contact includes one or more contact elements adapted to be in electrical contact with the second contact when the contacts are in the closed position, and a mesh made of metal arranged in thermal contact with the contact elements. The mesh is arranged to at least partly surround the contact elements to allow heat to conduct from the contact elements to the mesh.

20 Claims, 1 Drawing Sheet

(51) Int. Cl.

| | |
|---|---|
| ***H01H 1/06*** | (2006.01) |
| ***H01H 1/36*** | (2006.01) |
| ***H01H 1/62*** | (2006.01) |
| ***H01H 1/38*** | (2006.01) |
| ***H01H 45/10*** | (2006.01) |
| *H01H 33/70* | (2006.01) |

(56) References Cited

U.S. PATENT DOCUMENTS

| | | | | | |
|---|---|---|---|---|---|
| 3,613,037 | A | | 10/1971 | Kurtz | |
| 4,004,117 | A | * | 1/1977 | Amsler | 218/123 |
| 4,095,068 | A | * | 6/1978 | Meyer et al. | 218/58 |
| 5,654,532 | A | * | 8/1997 | Meyer et al. | 218/63 |
| 5,717,183 | A | * | 2/1998 | Lehmann et al. | 218/90 |

FOREIGN PATENT DOCUMENTS

| | | | |
|---|---|---|---|
| JP | 59-4121 | U | 1/1984 |
| JP | 62-121718 | U | 8/1987 |
| JP | 7-1404 | U | 1/1995 |

* cited by examiner

CIRCUIT BREAKER

FIELD OF THE INVENTION

The present invention relates to a circuit breaker including a first and a second contact movable relative each other between an open position, in which the contacts are at a distance from each other, and a closed position in which the contacts are in electrical contact with each other.

PRIOR ART

Generally, one of the contacts is stationary and the other contact is movable relative the stationary contact. However, in some applications both contacts are arranged movable relative each other. Typically, the contacts are surrounded by a dielectric medium, such as a gas or liquid. One of the contacts may include a plurality of contact elements, such as contact fingers, adapted to be in contact with the other contact when the contacts are in the closed position. The circuit breaker may also include an electrostatic shield assembly surrounding the contact elements.

In live tank circuit-breakers (LTB) the contacts are housed in insulators at high voltage potential. They are required to carry up to several thousand ampere of load current continuously, while not allowing the current carrying parts to exceed prescribed temperature rise limits.

Meeting load current rating requirements are usually achieved by using sufficiently large cross-section contacts of copper, aluminum or a combination of both. The highest current path resistance is normally encountered at the main contact connection points between the contacts. These contact points are normally silver coated to keep electrical resistance to a minimum. Cooling of the contact points and current paths is normally achieved by natural passive convention of the dielectric medium, surrounding the contacts. Forced cooling is impractical in circuit breakers due to cost and reliability reasons.

There is a desire to increase the current rating in circuit breakers. However, the current rating desired is limited by the heat losses at the contact connection points. Normal passive convection cooling can be inadequate to comply with the maximum allowed temperature rises in the contacts.

Thus, it is desired to increase the heat dissipation at the contact connection points using a reliable and cost effective passive design.

OBJECT AND SUMMARY OF THE INVENTION

The object of the present invention is to provide an improved circuit breaker with increased heat dissipation at the moving contact connection points using a reliable and cost effective passive design.

This object is achieved with a circuit breaker according to claim 1.

The circuit breaker is characterized in that the first contact comprises a mesh made of metal arranged in thermal contact with the contact elements to allow heat to conduct from the contact elements to the mesh, and the mesh is arranged to at least partly surround the contact elements and.

A metal mesh is a semi-permeable barrier made of metal wires. With thermal contact is meant that the distance between the mesh and the contact elements is such that heat is allowed to conduct from the contact elements to the mesh. Heat is conducted away from the contact points to the dielectric medium surrounding the contacts through the mesh. The metallic mesh dramatically increases the surface area in the vicinity of the contact points, and thereby facilitates more effective heat dissipation, while not unduly inhibiting the convection flow of dielectric medium to remove the heat from the contact area.

The proposed solution has the following benefits:

Passive, no moving parts, no maintenance

Easily incorporated into existing contact designs.

Simple assembly.

Low cost due to only one additional part, i.e. a metallic mesh.

The term circuit breaker also covers switches, breakers, interrupters, and disconnectors.

The present invention can be used for any type of circuit breaker, such as live tank, dead tank, GIS, High Voltage, Medium Voltage and even Low Voltage. The invention is focused on heat dissipation at the contact due to current flow, so it is "independent" of whatever voltage the interrupter or breaker is used at.

Suitably, the mesh is arranged to at least partly surround the contact elements. Preferably, the mesh is arranged to circumferentially surround the contact elements, thereby further increasing the surface area in the vicinity of the contact points.

According to an embodiment of the invention, the mesh is extending in axial as well as radial direction of the first contact. Thereby, heat dissipation from the contact points is increased.

According to an embodiment of the invention, the mesh at least extends along the length of the contacts elements in the axial direction of the first contact. Thereby the surface area in the vicinity of the contact points is increased, which provides more effective heat dissipation.

According to an embodiment of the invention, the first contact comprises a plurality of contact fingers adapted to be in contact with the second contact when the contacts are in the second position, and said mesh is arranged in thermal contact with the contact fingers.

According to an embodiment of the invention, the first contact comprises an electrostatic shield assembly surrounding the contact elements and arranged so that a space is formed between the contact elements and the electrostatic shield assembly, and said mesh is positioned in said space. This embodiment utilizes an already existing space of the contact, which makes the solution cost effective and does not increase the size of the contact.

According to an embodiment of the invention, the electrostatic shield assembly includes a wall facing away from the contact elements and the wall is provided with openings to improve ventilation of the space. Thereby, heat dissipation from the contact points is increased.

According to an embodiment of the invention, the mesh is knitted.

According to an embodiment of the invention the mesh is made of copper, a copper alloy, tinned copper, silver plated copper, tin-copper alloy, aluminum, aluminum alloy, steel or plated-steel. Those metals have good heat conducting properties.

BRIEF DESCRIPTION OF THE DRAWINGS

The invention will now be explained more closely by the description of different embodiments of the invention and with reference to the appended figures.

DETAILED DESCRIPTION OF PREFERRED EMBODIMENTS OF THE INVENTION

Figure 1:
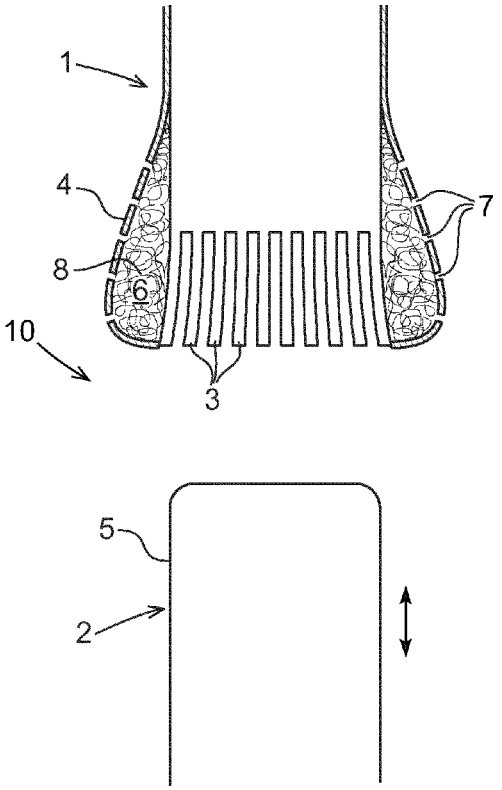
FIG. 1 shows a circuit breaker according to a first embodiment of the invention in an open position.
Figure 2:
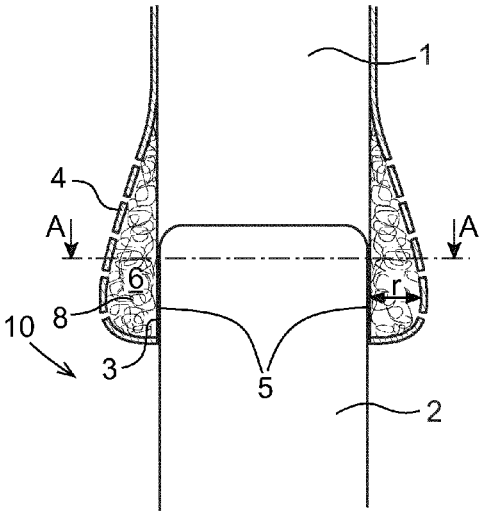
FIG. 2 shows the circuit breaker shown in FIG. 1 in a closed position.
Figure 3:
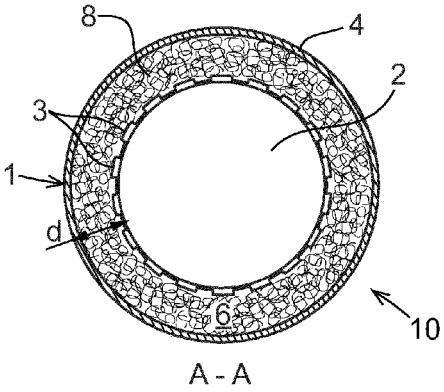
FIG. 3 shows a cross-section A-A through the circuit breaker shown in FIG. 2, in a closed position.

FIGS. 1-3 shows a circuit breaker 10 according to a first embodiment of the invention. FIG. 1 shows the circuit breaker 10 in an open position and FIG. 2 shows the circuit breaker 10 in a closed position. FIG. 3 shows a cross-section A-A through the circuit breaker 10 in the closed position. The circuit breaker 10 includes a first contact 1 and a second contact 2 movable relative each other between an open position, in which the contacts are at a distance from each other, as shown in FIG. 1, and a closed position, in which the contacts 1,2 are in electrical contact with each other, as shown in FIG. 2. Typically, one of the contacts is movable and the other contact is stationary. However, it is also possible that both contacts are movable. The first contact 1 includes one or more contact elements 3 adapted to be in contact with the second contact when the contacts are in the closed position. The contact elements are provided in one end of the first contact, and more particular the contact elements are provided in an end of the first contact that faces the second contact.

In this example, the first contact 1 is a stationary part and the second contact 2 is a movable part, and the stationary part has a plurality of contact fingers 3 that slide over and make contact to a matching contact surface 5 of the movable part 2. The contact fingers 3 are adapted to be in contact with the second contact 2 when the contacts are in the closed position. The contact fingers 3 are typically spring loaded to maintain a contact pressure. Other possible contact elements are, for example, "laminar" contacts, "multi-laminar" contacts, contact springs or spirals, individual spring loaded contact fingers.

The first contact 1 includes an electrostatic shield assembly 4 circumferentially surrounding the contact fingers and enclosing them. Thus, the contact fingers 3 are contained within the electrostatic shield assembly 4. A space 6 is formed between the contact fingers 3 and the electrostatic shield assembly 4. The space 6 has a diameter d. Further, the contacts 1,2 are enclosed in a housing (not shown) including an interrupting dielectric medium, for example, a gas such as SF6. The housing is surrounding the contacts and forms an interrupter chamber. The housing is, for example, made of an insulating material such as porcelain. The wall of the electrostatic shield assembly 4 may be provided with openings 7 to improve ventilation of the space and to allow clear flow of the interrupting dielectric medium and to facilitate efficient passive convention cooling of the connection area between the contact fingers 3 and the contact surface 5 of the second contact 2. However, the openings 7 are optional.

According to the invention, the first contact 1 comprises a mesh 8 made of metal arranged in thermal contact with the contact elements 3. With thermal contact is meant that the mesh is arranged closed enough to the contact elements to be able to conduct heat from the contact elements to the surroundings. Although it is to prefer that the mesh is in mechanical contact with the contact elements 3, the mesh does not necessarily have to be in direct mechanical contact with the contact elements. The mesh 8 is provided in the close vicinity of contact points between the first and second contact 1, 2 when the breaker is in the closed position. The mesh is arranged on the outside of the contact elements 3. The mesh 8 is arranged to at least partly surround the contact elements 3. Preferably, the mesh 8 is arranged to surround the contact elements 3 of the first contact 1. The mesh 8 is extending in axial as well as radial direction of the first contact 1. The mesh 8 at least extends along the length of the contacts elements 3 in the axial direction of the first contact 1. The mesh 8 extends a distance r in the radial direction of the contact, which depends on the size of the contact.

The contact elements are adapted to be in contact with a matching contact surface of the second contact when the contacts are in the closed position, and the mesh is arranged in close vicinity of contact points between the contact elements and the contact surface of the second contact.

The mesh is made of a material, which is a good heat conductor and heat radiator, and which also has some flexibility and durability to be able to stand likely flexing during breaker mechanical operations. Suitably, the mesh is made of a metal such as copper, a copper alloy, steel or equivalent. In this embodiment of the invention, the mesh 8 is arranged in the space 6 between the contact fingers 3 and the electrostatic shield 4. The metallic mesh 8 would dramatically increase the surface area in the vicinity of the contact points and facilitate more effective heat dissipation, while not unduly inhibiting the convection flow of dielectric medium to remove the heat from the contact area. The mesh is a semi-permeable barrier made of connected strands of metal. A metal mesh can, for example, be woven, knitted, welded, or expanded from copper, steel or other metals. The mesh 8 extends in three dimensions, and preferably fills the space 6 between the contact fingers 3 and the electrostatic shield 4. The mesh 8 in this example is made of metal wires which are arranged in an arbitrarily tangle.

Figure 4:
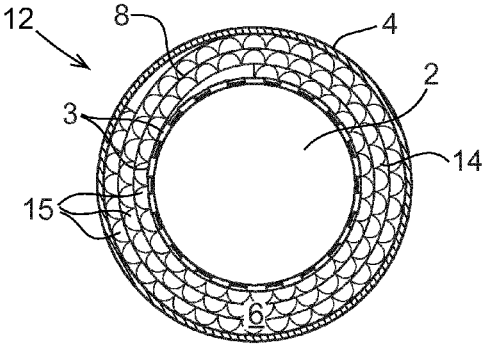
FIG. 4 shows a circuit breaker according to a second embodiment of the invention.

FIG. 4 shows another example of how the mesh can be arranged. A sheet of a knitted mesh 14 is arranged in the space 6 between the contact fingers 3 and the electrostatic shield 4. The knitted mesh has been wounded several layers 15 around the first contact in the space 6 between the contact fingers 3 and the electrostatic shield 4. The mesh fills up most of the space 6.

The present invention is not limited to the embodiments disclosed but may be varied and modified within the scope of the following claims. For example, if the circuit breaker does not have any electrostatic shield, the mesh can be arranged in the same way on the outside of the contact elements and in thermal contact with the contact elements.

The invention claimed is:

1. A circuit breaker including a first contact and a second contact movable relative to each other between an open position, in which the first contact and the second contact are at a distance from each other, and a closed position, in which the first contact and the second contact are in electrical contact with each other, and the first contact includes:

one or more contact elements adapted to be in electrical contact with the second contact when the first contact and the second contact are in the closed position, and a mesh made of metal arranged in thermal contact with the contact elements, wherein the mesh surrounds and defines a space that receives the contact elements therein to at least partly surround the contact elements.

2. The circuit breaker according to claim 1, wherein the contact elements are adapted to be in electrical contact with a matching contact surface of the second contact when the first contact and the second contact are in the closed position, and the mesh is arranged in close vicinity of contact points between the contact elements and the contact surface of the second contact.

3. The circuit breaker according to claim 1, wherein said mesh is extending in axial as well as radial direction of the first contact.

4. The circuit breaker according to claim 1, wherein said mesh at least extends along the length of the first contact and the second contact elements in the axial direction of the first contact.

5. The circuit breaker according to claim 1, wherein the first contact comprises a plurality of contact fingers adapted to be in contact with the second contact when the first contact and the second contact are in the second position, and said mesh is arranged in thermal contact with the contact fingers.

6. The circuit breaker according to claim 1, wherein the first contact comprises an electrostatic shield assembly surrounding the contact elements and arranged so that a space is formed between the contact elements and the electrostatic shield assembly, and said mesh is positioned in said space.

7. The circuit breaker according to claim 6, wherein the electrostatic shield assembly includes a wall facing away from the contact elements and the wall is provided with openings to improve ventilation of the space.

8. The circuit breaker according to claim 1, wherein the mesh is knitted.

9. The circuit breaker according to claim 1, wherein the mesh is made of copper, a copper alloy, tinned copper, silver plated copper, tin-copper alloy, aluminum, aluminum alloy, steel or plated-steel.

10. The circuit breaker according to claim 1, wherein the contact elements are provided in an end of the first contact that faces the second contact.

11. The circuit breaker according to claim 2, wherein said mesh is extending in axial as well as radial direction of the first contact.

12. The circuit breaker according to claim 2, wherein said mesh at least extends along the length of the first contact and the second contact elements in the axial direction of the first contact.

13. The circuit breaker according to claim 3, wherein said mesh at least extends along the length of the first contact and the second contact elements in the axial direction of the first contact.

14. The circuit breaker according to claim 2, wherein the first contact comprises a plurality of contact fingers adapted to be in contact with the second contact when the first contact and the second contact are in the second position, and said mesh is arranged in thermal contact with the contact fingers.

15. The circuit breaker according to claim 3, wherein the first contact comprises a plurality of contact fingers adapted to be in contact with the second contact when the first contact and the second contact are in the second position, and said mesh is arranged in thermal contact with the contact fingers.

16. The circuit breaker according to claim 4, wherein the first contact comprises a plurality of contact fingers adapted to be in contact with the second contact when the first contact and the second contact are in the second position, and said mesh is arranged in thermal contact with the contact fingers.

17. The circuit breaker according to claim 2, wherein the first contact comprises an electrostatic shield assembly surrounding the contact elements and arranged so that a space is formed between the contact elements and the electrostatic shield assembly, and said mesh is positioned in said space.

18. The circuit breaker according to claim 3, wherein the first contact comprises an electrostatic shield assembly surrounding the contact elements and arranged so that a space is formed between the contact elements and the electrostatic shield assembly, and said mesh is positioned in said space.

19. The circuit breaker according to claim 4, wherein the first contact comprises an electrostatic shield assembly surrounding the contact elements and arranged so that a space is formed between the contact elements and the electrostatic shield assembly, and said mesh is positioned in said space.

20. The circuit breaker according to claim 5, wherein the first contact comprises an electrostatic shield assembly surrounding the contact elements and arranged so that a space is formed between the contact elements and the electrostatic shield assembly, and said mesh is positioned in said space.

* * * * *